US005224875A

United States Patent [19]

Watanabe et al.

[11] Patent Number: 5,224,875

[45] Date of Patent: Jul. 6, 1993

[54] TERMINAL LUG-WATER SEALING PLUG COUPLING STRUCTURE

[75] Inventors: Hiroshi Watanabe; Kimiko Ohsaki; Mari Harada, all of Shizuoka, Japan

[73] Assignee: Yazaki Corporation, Tokyo, Japan

[21] Appl. No.: 833,694

[22] Filed: Feb. 11, 1992

[30] Foreign Application Priority Data

Feb. 12, 1991 [JP] Japan ..... 3-011469[U]

[51] Int. Cl.[5] ..... H01R 13/40

[52] U.S. Cl. ..... 439/587; 439/867

[58] Field of Search ..... 439/278, 279, 587, 588, 439/589, 523, 730, 867

[56] References Cited

U.S. PATENT DOCUMENTS

| | | | |
|---|---|---|---|
| 4,735,581 | 4/1988 | Endo et al. | 439/587 X |
| 4,895,533 | 1/1990 | Yagi et al. | 439/587 |
| 4,917,617 | 4/1990 | Smith | 439/587 X |
| 4,921,437 | 5/1990 | Cooper et al. | 439/595 X |

*Primary Examiner*—Larry I. Schwartz

*Assistant Examiner*—Khiem Nguyen

*Attorney, Agent, or Firm*—Armstrong, Westerman, Hattori, McLeland & Naughton

[57] ABSTRACT

The invention provides a terminal lug-water sealing plug coupling structure in a water-proof electric connector used for automotive wiring harnesses.

With the wire already passed through the water sealing plug, the wire conductor is crimped by the wire conductor crimping portion and the wire insulation is crimped by the wire insulation crimping portion to securely connect the wire to the terminal lug. At this time a pair of engagement projections are formed at the top and bottom of the wire insulation crimping portion.

In this condition, the water sealing plug is moved over the wire until the engagement projections fit into the engagement holes, firmly holding the terminal lug and the water sealing plug together. This engagement between the projections and the holes permits secure connection of the water sealing plug to the terminal lug in a predetermined attitude.

3 Claims, 2 Drawing Sheets

TERMINAL LUG-WATER SEALING PLUG COUPLING STRUCTURE

BACKGROUND OF THE INVENTION

1. Field of the Invention

This invention relates to a terminal lug-water sealing plug coupling structure in a water-proof electric connector mainly used for automotive wiring harnesses.

2. Description of the Related Art

Referring to FIG. 6, designated a is a terminal lug, b a water sealing plug made of soft rubber, c a wire, and d a connector housing of synthetic resin. The terminal lug a has an electric contact portion $a_1$ and a wire connecting portion $a_2$. The wire connecting portion $a_2$ consists of a conductor crimping portion $a_3$ and a wire insulation crimping portion $a_4$. The water sealing plug b has an axial through-hole (not shown) through which the wire c can be passed, and also has a fixing portion $b_1$ at the front half and a circular sealing portion $b_2$ at the rear half.

The wire c is connected to the terminal lug a in the following procedure. The wire c is passed into the through-hole of the water sealing plug b; a conductor $c_1$ of the wire c is crimped by the conductor crimping portion $a_3$; and an insulation crimping portion $a_4$ placed over the fixing portion $b_1$ of the water sealing plug b is pressurized to crimp a wire insulation $c_2$ so that the water sealing plug b along with the wire c can be fixed to the terminal lug a.

SUMMARY OF THE INVENTION

In the above-mentioned conventional device, since the wire insulation cz is crimped from outside the fixing portion $b_1$ of the water sealing plug b, the fixing portion $b_1$ is subjected to a strong compression force and is likely to develop cracks, making it impossible to maintain a stable connection between the terminal lug a and the water sealing plug b. At the same time, the strong crimping force tends to twist the water sealing plug b, making the correct positioning of the plug difficult.

With a view to overcoming this drawback, the invention provides a coupling structure which fixes the water sealing plug to the terminal lug without applying a crimping pressure on the plug.

To achieve the above objective, this invention crimps the wire at the wire connecting portion of the terminal lug and provides engagement projections at the wire connecting portion so that the engagement projections engage with engagement holes in the water sealing plug sleeved over the wire.

The wire is first inserted through the water sealing plug and then connected to the terminal lug. The water sealing plug is moved until the engagement projections of the terminal lug fit into the engagement holes of the plug, thereby fixing the terminal lug and the water sealing plug securely together.

DETAILED DESCRIPTION OF PREFERRED EMBODIMENT

Figure 1:
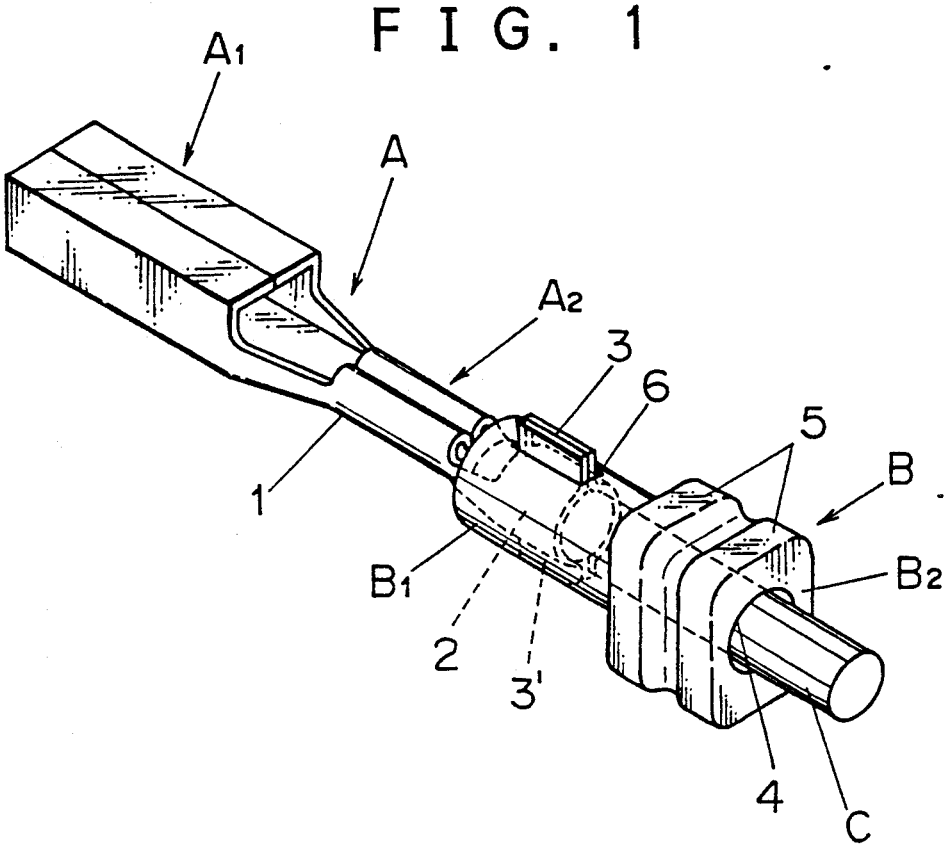
FIG. 1 is a perspective view of one embodiment of the invention.
Figure 2:
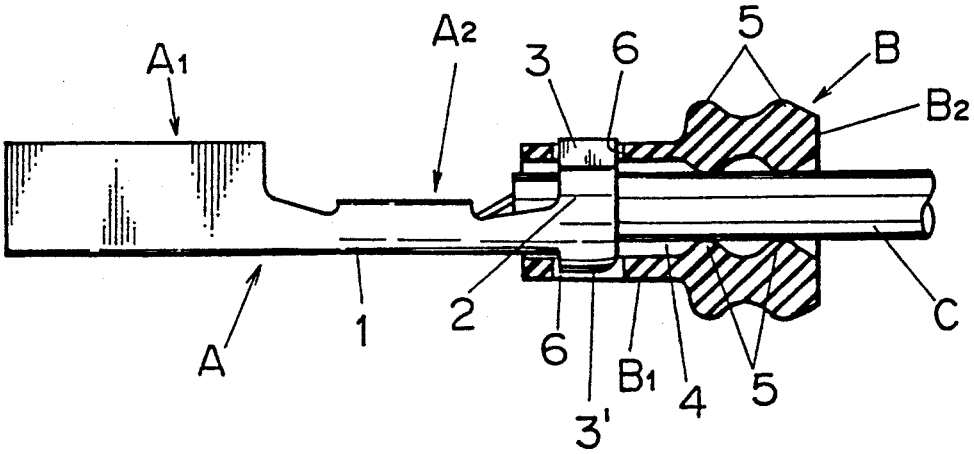
FIG. 2 is an axial center cross section of a water sealing plug of FIG. 1.
Figure 3:
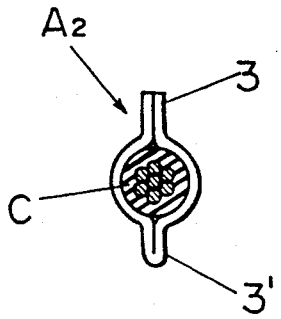
FIG. 3 is a transverse cross section of a wire connecting portion of FIG. 1, taken along a plane perpendicular to the axis of the wire connecting portion.

In FIG. 1, reference symbol A represents a terminal lug, which consists of a female electric contact portion $A_1$ and a wire connecting portion $A_2$ formed integral with the former. The wire connecting portion $A_2$ has a wire conductor crimping portion I and a wire insulation crimping portion 2. The wire insulation crimping portion 2 has engagement projections 3,3' protruding upward and downward vertically symmetrically and extending in the axial direction, as shown in FIG. 1 and 2, in which the wire C is shown crimped by the wire insulation crimping portion 2. As shown in FIG. 3, the engagement projections 3, 3' are formed of a plate folded together.

A water sealing plug B made of soft rubber consists of a sealing portion $B_2$ square in transverse cross section and a fixing portion $B_1$ circular in transverse cross section, these two portions being formed integral with each other. The water sealing plug B has a wire insertion hole 4 formed axially therethrough which extends from the sealing portion $B_2$ to the fixing portion $B_1$. The sealing portion $B_2$ has water sealing annular ribs 5 formed on its outer circumference, and the fixing portion $B_1$ has a pair of engagement holes 6, 6 formed at upper and lower symmetrical positions therein and extending in the axial direction.

In the above construction, with the wire C already inserted through the water sealing plug B, the wire conductor $C_1$ is crimped by the wire conductor crimping portion 1 and the wire insulation $C_2$ is crimped by the wire insulation crimping portion 2, thus fixing together the wire C and the terminal lug A. At this time, the wire insulation crimping portion 2 is formed with a pair of vertically protruding engagement projections 3, 3' at the top and bottom.

Then, the water sealing plug B is moved over the wire C until the engagement projections 3, 3' fit into the engagement holes 6 to firmly connect the water sealing plug B to the terminal lug A. The engagement between the projections and the holes enables the water sealing plug B to be securely connected to the terminal lug A in a predetermined attitude. That is, the water sealing plug B having a square sealing portion $B_2$ can be connected to the terminal lug in a specified attitude so that when the terminal lug is inserted into a terminal accommodating chamber in the connector housing, the water sealing plug can be fitted, without being twisted, into the terminal accommodating chamber that has a cross-sectional shape, square or oval, corresponding to that of the plug.

Figure 4:
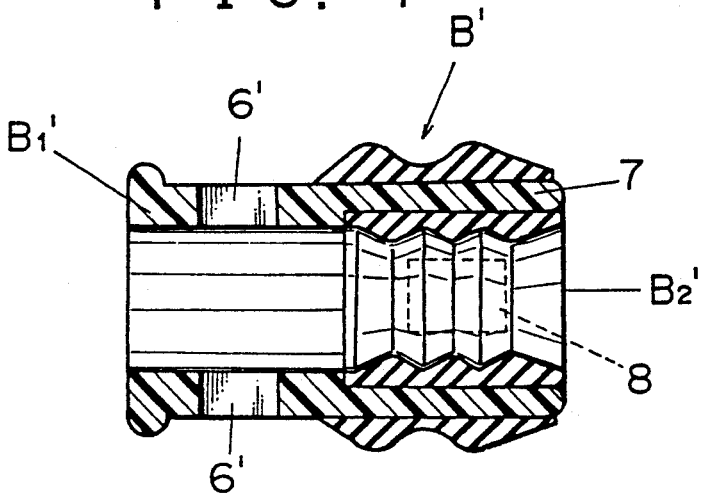
FIG. 4 is a cross section showing another structure of the water sealing plug.
Figure 5:
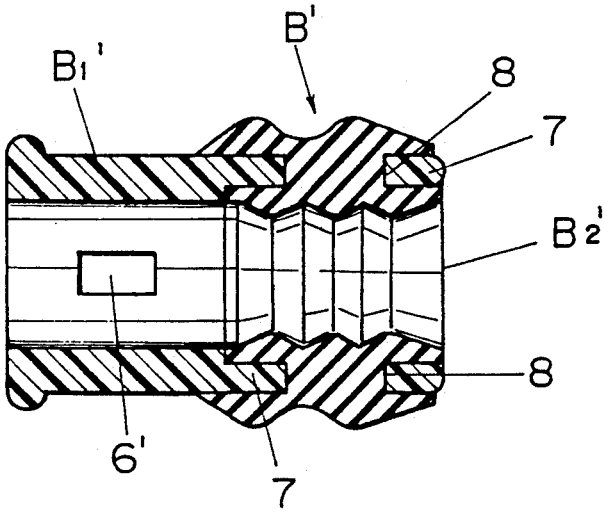
FIG. 5 is an axial center cross section of FIG. 4.
Figure 6:
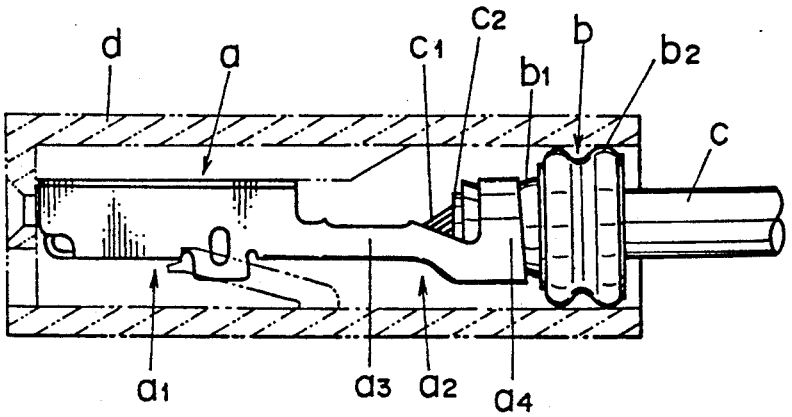
FIG. 6 PRIOR ART
FIG. 6 is a cross section of a conventional coupling structure.

In other embodiments of FIGS. 4 and 5, the water sealing plug B' has a core cylinder 7 of relatively soft synthetic resin provided inside and as one piece with the sealing portion $B_2'$. The core cylinder 7 has a forward portion and a rearward portion. The forward portion acts as a fixing portion $B_1'$, whereas the rearward portion is formed with a through-hole 8. The fixing portion $B_1'$ has a pair of engagement holes 6',6' formed at vertically symmetrical positions. This construction reinforces the fixing portion $B_1'$. Through the through-hole the inner and outer layers of the sealing portion $B_2'$ are joined such that the sealing portion $B_2'$ is secured to the rearward portion of the core cylinder 7.

The features and advantages of this invention may be summarized as follows. The wire is firmly connected to the terminal lug at the wire connecting portion of the latter. The wire connecting portion is provided with engagement projections, which are fitted into engagement holes in the water sealing plug sleeved over the wire. This construction permits the water sealing plug fitted over the wire to be securely connected, with sufficient strength, to the wire connecting portion of the terminal lug. It also allows the water sealing plug to be connected to the terminal lug in a predetermined attitude.

What is claimed is:

1. A terminal lug-water sealing plug coupling structure comprising:

a terminal lug having a wire connecting portion;

a water sealing plug having a sealing portion and a fixing portion, aid fixing portion being fitted over a round wire;

a plurality of engagement projections provided to said wire connecting portion of the terminal lug; and a plurality of engagement holes formed in said fixing portion of the water sealing plug;

whereby said plurality of engagement projections fit into the plurality of engagement holes, respectively, such that the water sealing plug is securely connected to the terminal lug in a predetermined circumferential orientation.

2. A terminal lug-water sealing plug coupling structure according to claim 1, wherein said fixing portion and said sealing portion are integral.

3. A terminal lug-water sealing plug coupling structure according to claim 1, wherein said water sealing plug has a core cylinder having a forward portion and a rearward portion, said forward portion acting as said fixing portion, said rearward portion being formed with a through-hole therein, said sealing portion of the water sealing plug being fitted to said rearward portion through said through-hole.

* * * * *